US007952301B2

(12) United States Patent
Biegel

(10) Patent No.: US 7,952,301 B2
(45) Date of Patent: May 31, 2011

(54) AUTO-DIMMING APPARATUS FOR CONTROLLING POWER DELIVERED TO A LOAD

(76) Inventor: George E. Biegel, Mission Viejo, CA (US)

( * ) Notice: Subject to any disclaimer, the term of this patent is extended or adjusted under 35 U.S.C. 154(b) by 356 days.

(21) Appl. No.: 12/316,492

(22) Filed: Dec. 12, 2008

(65) Prior Publication Data

US 2010/0148692 A1 Jun. 17, 2010

(51) Int. Cl.
*H05B 37/02* (2006.01)

(52) U.S. Cl. ..... 315/291; 315/224; 315/274; 363/16

(58) Field of Classification Search ..... 315/209 R, 315/224–226, 274, 276–279, 282–283, 291, 315/294, 307–308; 363/16, 21.09, 21.16, 363/25; 323/250, 255, 355, 358
See application file for complete search history.

(56) References Cited

U.S. PATENT DOCUMENTS 4,005,335 A * 1/1977 Perper ..... 315/224
5,880,946 A * 3/1999 Biegel ..... 363/75
6,040,662 A * 3/2000 Asayama ..... 315/291
6,815,906 B1 * 11/2004 Aarons et al. ..... 315/209 R
7,274,574 B1 * 9/2007 Biegel ..... 363/16
7,550,928 B2 * 6/2009 Liu ..... 315/276
2008/0258640 A1 * 10/2008 Masuda ..... 315/224
2010/0039048 A1 * 2/2010 Liu et al. ..... 315/307
2010/0134023 A1 * 6/2010 Mills ..... 315/174

* cited by examiner

*Primary Examiner* — Douglas W Owens
*Assistant Examiner* — Tung X Le
(74) *Attorney, Agent, or Firm* — Charles Bickoff

(57) ABSTRACT

A circuit with a magnetically variable inductor that is placed in close proximity to an independently wound control coil and connected in parallel to a current transformer having primary and secondary windings wound on a magnetic core wherein the transformer core with associated windings. The inductor core is placed within the bore of the control coil and an optional focusing armature concentrates the magnetic field at the poles. Application of a control current forms poles at the control coil extremities and causes a change in magnetic properties of the inductor core thereby altering the power output of the current transformer inversely to the magnitude of the control current. The control current from the output of the secondary coil of a current transformer in series with the load and conditioned by a feedback conditioning circuit modulates the level of the control current. The magnetically variable inductor controls a D.C. to A.C. power inverter circuit, which is useful in supplying power to a fluorescent lamp and other A.C. receptive loads connected to the output of an inverting circuit. Additionally, a microprocessor optionally modulates the feedback from the secondary of the current transformer while receiving inputs from manual and automatic environmental controls.

18 Claims, 4 Drawing Sheets

AUTO-DIMMING APPARATUS FOR CONTROLLING POWER DELIVERED TO A LOAD

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

The present invention pertains to the field of Power Inverter Circuits used to convert direct current, D.C., to alternating current, A.C. In general, such apparatus have been designed to receive a D.C. input, which in turn is converted to an A.C. source suitable for driving an A.C. receptive load. The disclosed apparatus controls the power inverter circuit by altering the magnetic characteristics of the inductor connected in parallel with the primary of the transformer, which supplies current or voltage to the control pin of the power inverter transistors. The alteration of the magnetic characteristics of the inductor may be influenced by a voltage derived from a current transformer in series with the A.C. receptive load.

2. Prior Art

A common power inverter application is to provide compatible A.C. power to operate different loads such as fluorescent lamps, Cold Cathode Fluorescent lamps, and electroluminescent panels, halogen lamps, H.I.D. lamps, Metal Halide lamps. This power inverter may be used as a switching power supply for numerous other types of loads. Fluorescent lamps are commonly used to provide illumination, particularly in industrial environments where their economy of power utilization is highly desirable. Because of their greater efficiency in converting electricity to light, the cost of utilization is significantly reduced when compared to incandescent lighting.

Cold Cathode Fluorescent lamps (CCFLs) are used to backlight Liquid Crystal Displays (LCDs) in computer applications while Electro-luminescent (EL) panels are used to backlight LCDs, key switches, and other devices in many applications. Their popularity is due to high efficiency and small size. These devices require a high voltage ac current to drive them. Power inverter circuits commonly supply this power.

A common limitation of these Power Inverter Circuits has been that they have required sophisticated circuitry to vary the brightness of the above-mentioned lamps and other loads. Most modern fluorescent lamp ballasts utilize a D.C. to A.C. inverter circuit to strike and supply operating power to the lamps. Many power inverter circuits commonly supply a non-variable voltage to the load. As control circuitry is added to accomplish regulation or dimming of the light source, the complexity and cost has historically increased dramatically while the reliability and manufacturing consistency have decreased. Additionally, the control circuitry often interacts in an undesirable manner with various aspects of the circuitry thereby requiring further complexity to compensate for these effects. Furthermore, dimming at low levels and from multiple sensory control elements is limited.

Likewise, switching power supplies and high frequency supplies for driving halogen lamps commonly suffer from the same limitations.

In Biegel U.S. Pat. No. 7,274,574, auto-dimming of a Magnetically Controlled Power Supply is taught. There is a level where the inductance of the primary becomes low enough that the circuit fails to function and the circuit turns off.

The present invention addresses the above limitations. The first is that an inductor is placed in parallel with the Control Transformer primary to control the amplitude of the output of the power inverter circuit. Secondly, the present invention teaches methods in which multiple control elements can control the output level interactively. The third is that the apparatus described herein is isolated and independent from the drive circuitry. It requires very few components and does not require complex feedback loops to control the inverter output level. Fourthly, when used to drive a fluorescent lamp load, a series resonant circuit comprised of an inductor and resonant capacitor is often used to boost the voltage level to that required to strike and operate the lamp. By adding a Current Transformer in series with the lamp, a secondary coil is used to generate a feedback voltage, this voltage can be used to supply the control current on a delayed basis and thereby provide full start up power to the fluorescent lamp load independent of the setting of any dimming or level controls. Alternatively, in conjunction with a simple RC timer, the modified power inverter circuit is also able to strike the lamps at a very low dimming level. Additionally the feedback voltage can be supplied to a variety of feedback circuits to condition the signal or feed it through a microprocessor to tailor the input to supply the desired effect. Various input devices can be used to control the output level.

BRIEF SUMMARY OF THE INVENTION

The invention herein described is for a circuit, which utilizes a magnetically controlled inductor, which is useful to control the power level supplied to loads such as fluorescent lamps, LCDs, electroluminescent lamps, halogen lamps, H.I.D. lamps, Metal Halide lamps. It also has uses in controlling the output power level in switching power supplies. The method utilized in controlling the power output involves applying an external non-coupled controlling magnetic field to the core of the magnetically controlled inductor.

The present invention includes a magnetic means to control the power output of a secondary winding of a control transformer by applying an input electrical control signal to the primary winding. This generates an output electrical signal in a secondary coil. A control winding is wound on a bobbin or pair of serially connected bobbins and a control inductor is placed within its bore, which generates a control electrical signal. This control inductor and its core of magnetic material is placed in the magnetic flux path of the control winding. The maximum result is usually obtained when the control inductor and its core of magnetic material is placed at the center within the control winding bobbin and magnetic material closes the magnetic flux path of the control winding. If the magnetic core of the control inductor is part of a closed magnetic field with the control inductor, then this control means is independent of the core upon which the primary and secondary windings of the control transformer are wound. This control inductor is connected in parallel with the primary of the control transformer. The control inductor being wound on an independent bobbin with its magnetically coupled and isolated core does not induce a voltage in either the primary or the secondary windings of the control transformer. It also does not induce a voltage in the control winding. The magnetic field generated by the control winding acts as a magnetic valve to control the circulation of flux in the core of the control inductor by the application of a D.C. voltage to the control winding which creates a polarized field in the portion of the transformer core adjacent to the polarizing control core.

A current transformer placed in series with the load can provide the control current supplied to the control winding. The current transformer has at least one secondary winding. This supplies a current proportional to the load current and conditioned by appropriate circuitry, provides a DC signal of sufficient amplitude to be useful to control the magnetically controlled control transformer.

Additionally, this apparatus provides a magnetic means for controlling the control pin of the switching transistors, which in-turn control the A.C. voltage applied to a load. Switching transistors can be bipolar transistors, which are current driven devices, that have an emitter (output pin), collector (input pin) and base (control pin), while mosfets, which are voltage driven devices, have a source (input pin), drain (output pin), and gate (control pin). It will be recognized by those skilled in the art that a combination of these semiconductor components can also be used and that in the case of a PNP transistor the output and input pins will be reversed in comparison to a NPN transistor. The load may be a gas discharge lamp. The control circuit can also provide a dimming or brightness control function with a variable resistor, thermistor, or light sensitive resistor to control the voltage and current supplied to the control winding.

The purpose of the disclosed invention is to firstly maintain the output of the load and secondly in a further embodiment allow the input of various sensors and adjustment means to vary the output to the load in a predetermined or manually determined way.

DETAILED DESCRIPTION OF THE INVENTION

The following description illustrates the invention by way of example, not by way of limitation the principles of the invention. The description will clearly enable one skilled in the art to make and use the invention. It describes embodiments, variations, and adaptations including what is believe to be the best mode. In the various figures the power inverter circuit is depicted using bipolar transistors. It is not intended that this be a limitation to the scope of the present invention as it will be recognized by those skilled in the art that power inverter circuits can be constructed using other semiconductor devices such as mosfets, scrs (silicon controlled rectifier), and the like to achieve the same result. Likewise the load is shown as a lamp but as will be recognized other devices may be controlled using the disclosed invention and it is not intended to limit the scope of the invention to lighting applications.

Figure 1:
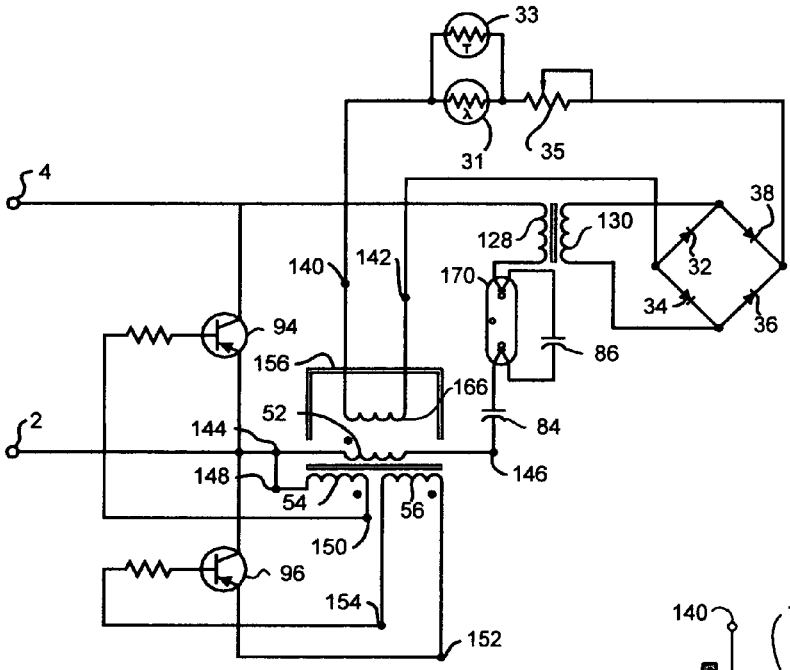
Prior Art Fig. 1
FIG. 1 is a prior art schematic of a power inverter circuit with magnetic control of control signals of a pair of inverter transistors wherein the control winding is wound on a bobbin and the control transformer is placed within the bore of the winding. Control elements serve to regulate the current flowing through the control winding.

FIG. 1 depicts a circuit with an electrically isolated magnetically coupled control coil in the construction of the output transformer and serves as prior art to the present invention. This transformer construction consists of a core cooperatively wound with a primary 52 and at least 1 secondary winding. In the configuration depicted, there are two secondary windings, 54 and 56, each of which are connected respectively to the base (control pin) of an inverter transistor with the windings oppositely poled such that the outputs are out of phase. This allows the inverter transistors, 94 and 96, to be turned on and off out of phase and alternately create the positive and negative A.C. half cycles. Inductor 128 and capacitor 84 forms a series resonant circuit useful for boosting the power inverter output to a high voltage high frequency signal necessary to drive the lamp 170 without flicker. A starting capacitor 86 is connected across the lamp load to provide a warming current for the filaments in the lamp. Initially the lamp 170 has high impedance, which allows the capacitor 86 to rapidly charge and provide this current. Upon striking, the lamp impedance decreases dramatically limiting the charging current to capacitor 86.

Figure 2:
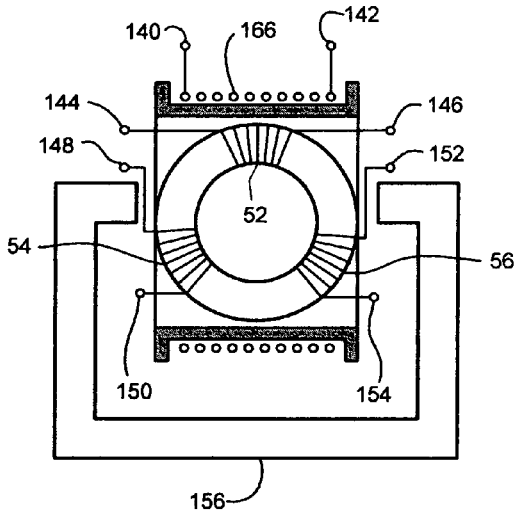
Prior Art Fig. 2
FIG. 2 is a partially sectioned plan view of the output transformer arrangement showing the output transformer arranged within a bobbin upon which is wound the control coil. A magnetic shunt concentrates the magnetic control field at substantially opposing points on the circumference of the output transformer.
Figure 8:
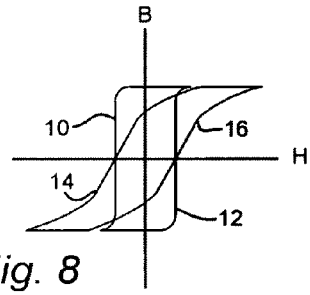
FIG. 8 is a B/H curve showing the change in coercivity due to the influence of an externally applied magnetic field.

As stated above the transformer is constructed in this case having a primary 52 and two secondarys 54 and 56. The output transformer consisting of the primary coil 52 and secondary windings, 54 and 56 are wound on a core that is optionally placed, for higher efficiency, within the bore of a bobbin wound with the control coil 166. Optionally, a magnetic concentrator 156, as shown in FIG. 2, focuses the magnetic field at the opposite ends of the bobbin in close proximity to the core and windings of the output transformer. As will be recognized by those skilled in the art, the control transformer can be placed in any other position along the magnetic path of the control coil. For clarity, the control coil is sectioned to show the arrangement of the transformer within the control coil. Applying a D.C. voltage to the control coil 166 through coil leads 140 and 142 causes a change in the apparent magnetic properties. The application of a D.C. current or low frequency A.C. current to the control coil 166 produces a magnetic field across the poles. When placed in close proximity to the transformer core, increasing the field strength increases the apparent magnetic properties of the transformer core thereby reducing the current output and power from the secondary windings while maintaining the voltage, which is a function of the primary to secondary, turns ratio. In effect, the north pole of the control core generates a south pole adjacent to it in the transformer core and likewise the south pole of the control core generates a north pole adjacent to it in the transformer core. FIG. 8 shows a B/H curve representation wherein the curve bounded by 10 and 12 represents the magnetic characteristics of the transformer core prior to the application of the control current while the B/H curve bounded by 14 and 16 depict the characteristics after the application of the control current. The creation of these poles in effect changes the magnetic properties of the transformer core and the output current varies inversely with respect to the magnetic properties.

B=flux density; H=magnetic intensity; μ=permeability;

l=length of the mean magnetic path; and i=current;

N=number of turns $H=B/\mu=Ni/l$ $\therefore i=Bl/\mu N$

Additionally, inductor 130, when wound on the same core as inductor 128 forms the secondary of a voltage reduction transformer. This, A.C. output voltage when rectified by the rectifier formed by diodes 32, 34, 36, and 38 can serve as the control voltage that supplies control coil 166. As stated above, when the circuit initially starts, the lamp impedance is very low and inductor 128 will be close to saturation. This will result in a very low voltage in the secondary 130. The result will be that full startup power will be applied to the lamp load at full brightness. As the impedance of the lamp increases the voltage in the secondary will ramp up to the value preset by the turn ratio and the control coil 166 will bring the lamp brightness to the set dimming level. Due to the high frequency of the control voltage, a filter capacitor is unnecessary, as noticeable flicker will not occur at 20 kHz. There is no power in the dimming circuit if the lamp 170 is disconnected or a filament fails at end of life.

FIG. 1 also shows control current modifying elements 31, 33, and 35. These resistive elements vary their resistance with respect to light, temperature, or adjusted resistance. As the resistance of these elements increase, the control current will decrease and the output current of the output transformer will increase, thereby increasing the brightness of the lamp 170. Inversely when the resistance of these elements decrease, the control current will increase and the output current of the output transformer will decrease, thereby decreasing the brightness of the lamp 170. These elements may be utilized singularly or in series or parallel combinations to achieve the desired control results. The use of the light sensitive resistor can control the power output of the transformer based on the light output of the lamp or the ambient light level. In the first case, the current will be adjusted to keep the light output constant while in the second case the brightness might be adjusted inversely to the ambient light level. The thermistor might be used to provide maximum current at low temperatures to assure starting while reducing the current at higher temperatures. The variable resistor allows the lamp to be dimmed according to the desired level of light. It will be recognized by those familiar with the art that other control elements, which actively or passively vary the magnitude of the control current, are applicable to the scope of the invention. It will also be recognized by those skilled in the art that the invention is not limited to toroidal transformers as shown in the figures, but that other shaped magnetic cores having a complete magnetic path are consistent with the intent of the present invention.

Figure 3:
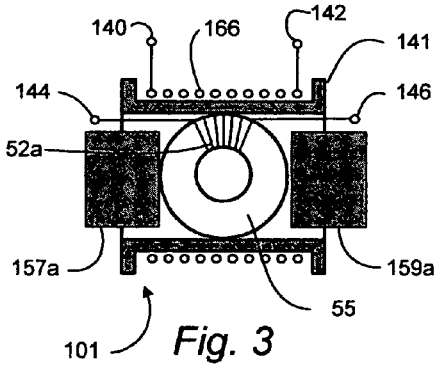
FIG. 3 is a second partially sectioned plan view of another control apparatus arrangement showing the control inductor arranged within a bobbin upon which is wound the control coil. The coil on the core of the control inductor is arranged in parallel with the primary of the control transformer. Magnetic cores concentrate the magnetic control field at substantially opposing points on the circumference of the control inductor.
Figure 6:
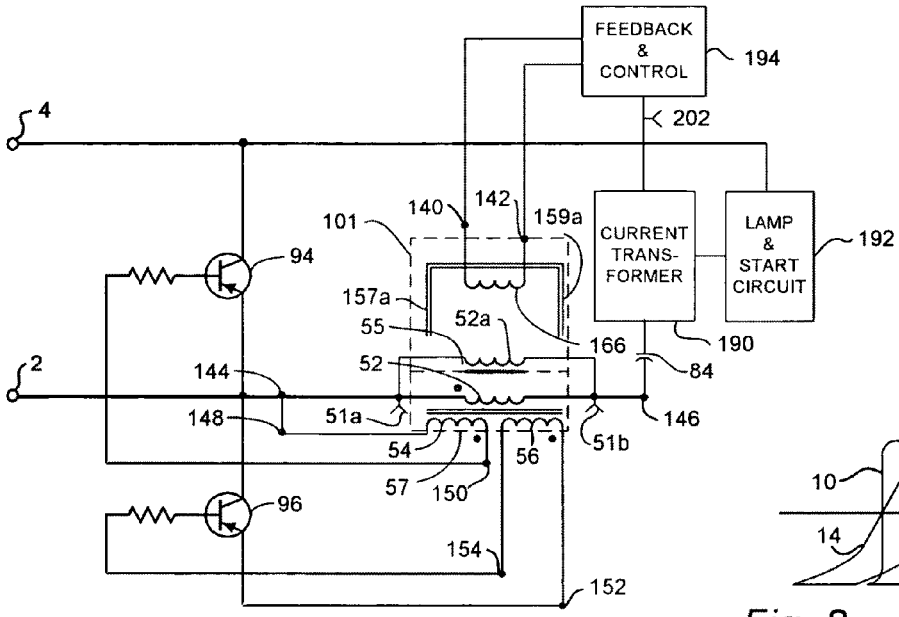
FIG. 6 is a simplified schematic of a power inverter circuit with magnetic control of the base currents of a pair of inverter transistors. The control coil is wound on a bobbin, which is magnetically coupled to the toroidal core of the control inductor, which is connected in parallel with the primary of the control transformer. Control elements serve to regulate the current flowing through the control coil. A current transformer, Lamp and Starting Circuit, and Feedback and Control are shown as blocks to be further described in additional Figures.

FIG. 6 shows a variation of FIG. 1 wherein the circuit functions represented as "Feedback and Control", "Current Transformer", and "Lamp & Start Circuit" are depicted as functional blocks. The "Feedback and Control" is replaced in the alternative by FIG. 9, 10, 11, 12 or 13. FIG. 6, additionally, depicts a modification to the circuit of FIG. 1 where the control transformer 57 has been reconfigured to include a control apparatus 101 containing a control coil 166, wound on a bobbin 141 as shown in FIG. 3, and a control inductor 52*a* wound on a core of magnetic material 55. The core magnetic material 55 is placed within bobbin 141, as shown in FIG. 3, and centrally located by ferromagnetic poles 157*a* and 159*a*, for maximum efficiency, but as previously noted, it can also be placed anywhere in the magnetic path of coil 166. Control inductor 52*a* is connected in parallel with the primary 52 of the control transformer 57. This embodiment allows sufficient current to be supplied to each base of transistors 94 and 96 to assure operation at low dimming levels and prevents the circuit from shutting off even when the inductance of control inductor 52*a* is very low, in a lighting application.

Figure 4:
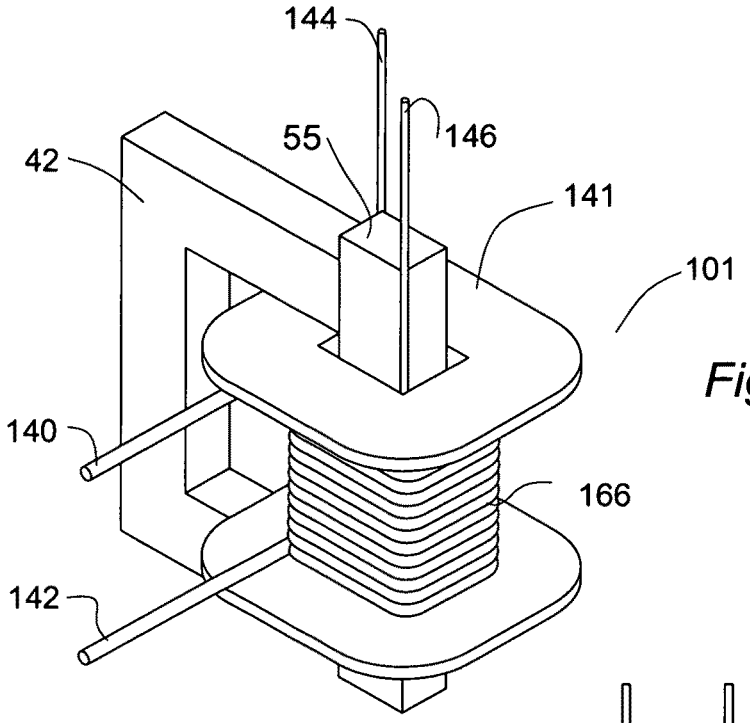
FIG. 4 is a perspective view of a further control apparatus.

FIG. 4 shows a preferred arrangement of the control apparatus 101 where the coil 166 is wound on the bobbin 141. Coil 166 further has leads 140 and 142, which connect as shown in FIG. 6. The core of magnetic material 55 is wound with control inductor 52*a* as shown in FIG. 5 and has leads 144 and 146, which likewise connect as shown in FIG. 6. Additionally, magnetic shunt 42 has ferromagnetic poles 157*a* and 159*a*.

FIG. 5 is a cross-section of the control apparatus 101 of FIG. 4 showing the detail of the construction particularly of the control inductor 52*a* wound on the core opening 46 of the core of magnetic material 55.

Figure 5A:
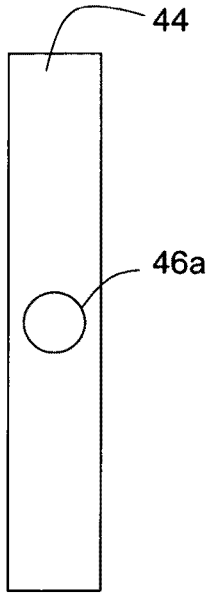
FIG. 5*a* shows the magnetic core of FIG. 5 with a circular opening.
Figure 5:
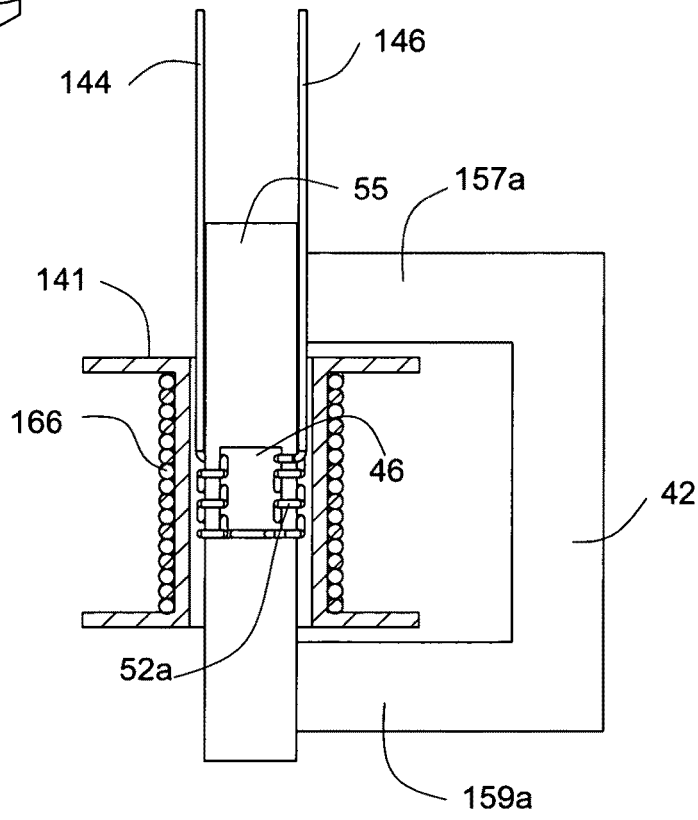
FIG. 5 is a partially sectioned plan view of the control apparatus arrangement of FIG. 4 showing the control inductor arranged within a bobbin upon which is wound the control coil. The coil on the core of the control inductor is arranged in parallel with the primary of the control transformer. The magnetic core is shown with a rectangular opening upon which the control inductor is wound. A magnetic shunt completes the magnetic path.

FIG. 5*a* shows an alternate core opening 46*a* within the core of magnetic material 55.

Figure 7:
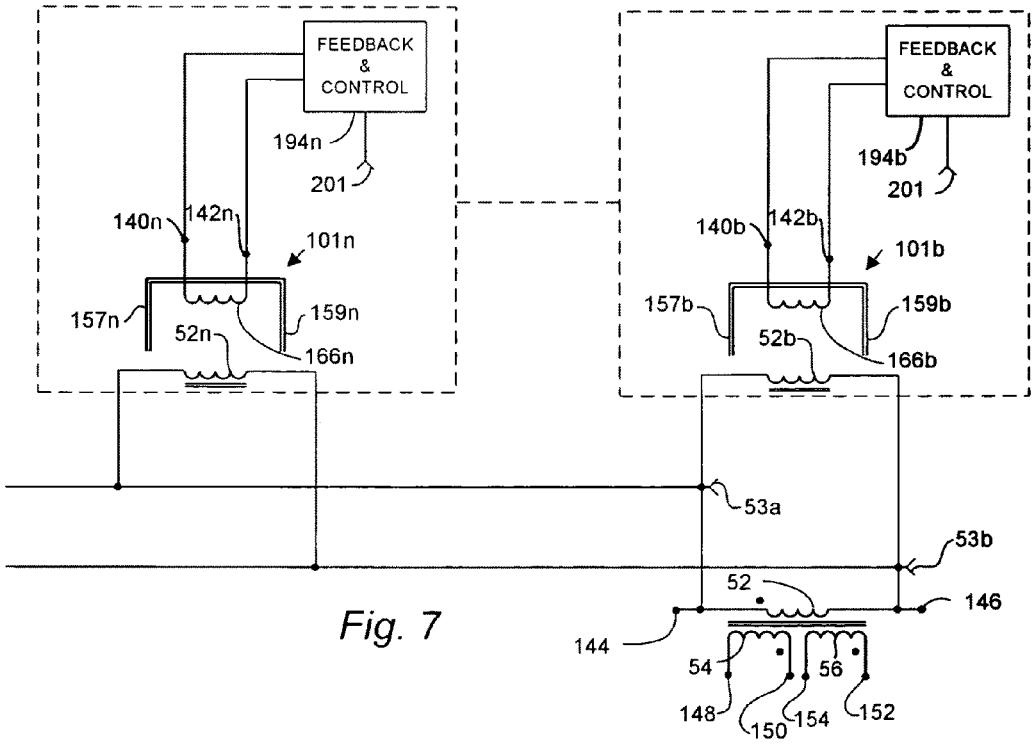
FIG. 7 is a partial schematic showing multiple magnetically coupled control apparatus connected in parallel to the primary of the control transformer.

FIG. 7 depicts the use of multiple control apparatus 101*b* through 101*n* having coils 52*b* through 52*n* connected in parallel with primary coil 52 of the control transformer. Connection point 53*a* connects to connection point 51*a* in FIG. 4, while Connection point 53*b* connects to connection point 51*b* in FIG. 4. As these control apparatus 101*b* through 101*n* are connected in parallel to primary 52 of the control transformer, they individually contribute to the output reduction effect without causing the circuit to turn off. In lighting applications, it is useful to have varying inputs such as ambient light, environmental temperature, and circuit case temperature control the power level of the circuit and thereby the change the output level to the attached load 170 as shown in FIG. 1. FIG. 7 also shows connection points 201 in the Feedback and Control 194*b* and 194*n*, which connect to connection point 202 in FIG. 6.

Figure 9:
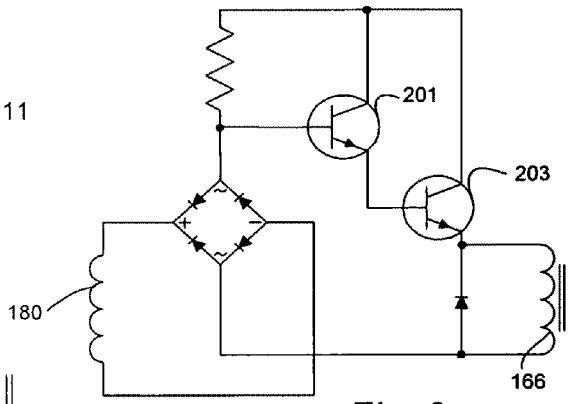
FIG. 9 is a schematic of a DC (Direct Current) coupled Feedback and Control Circuit.

FIG. 9 shows a circuit useful for D.C., direct current, coupling of the feedback coil 180 of the current transformer 190 to the control coil 166. The voltage supplied by feedback coil 180 is amplified by a single stage or multiple stage transistor network shown in FIG. 9 as 201 and 203 providing an output voltage proportional to the voltage generated by feedback coil 180.

Figure 10:
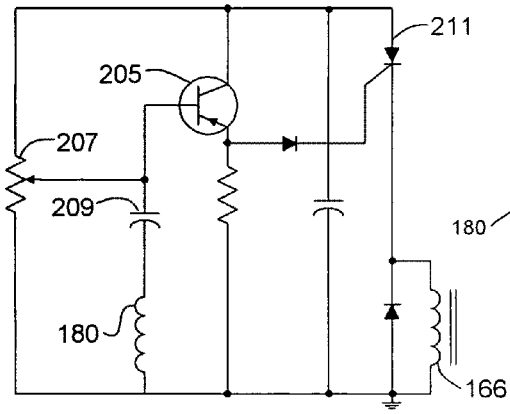
FIG. 10 is a schematic of an AC (Alternating Current) coupled Feedback and Control Circuit.

FIG. 10 shows a circuit useful for A.C., alternating current, coupling of the feedback coil 180 of the current transformer 190 to the control coil 166. The voltage supplied by feedback coil 180 is used to set the frequency of the output of the transistor 205 regulated by the RC network connected to the transistor base. Resistor 207 and capacitor 209, wherein resistor 207 may be variable to adjust the frequency, form the RC network. The output of transistor 205 is then used to switch the SCR 211 on to provide power to the control coil 166.

Figure 11:
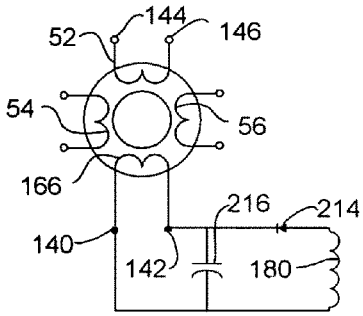
FIG. 11 is a simplified schematic showing a method to control the power level delivered to the control coil from the current transformer.

FIG. 11 shows a circuit wherein the voltage from the feedback coil 180 of the current transformer 190 is boosted by transistor 217 and transformer 219 to the control coil 166 and is rectified by diode 214 and filtered by capacitor 216. This method directly controls the voltage level delivered to the lamp 170 and maintains the lamp level based upon the voltage developed in the feedback coil 180 of the current transformer 190.

Figure 12:
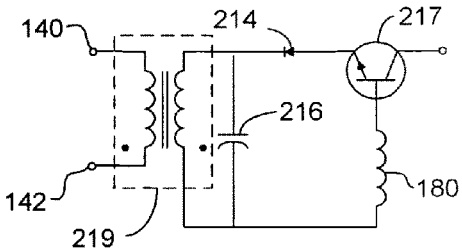
FIG. 12 is a schematic showing a method of directly controlling the voltage delivered to the output based on the voltage developed in the control coil from the current transformer.

FIG. 12 is a schematic showing a method of directly control the voltage delivered to the output based on the voltage developed in control coil from the current transformer. FIG. 12 shows a circuit wherein the voltage from the feedback coil 180 of the current transformer 190 is boosted by transistor 217 and transformer 219 to the control coil 166 and is rectified by diode 214 and filtered by capacitor 216. This method directly controls the voltage level delivered to the lamp 170 and maintains the lamp level based upon the voltage developed in the feedback coil 180 of the current transformer 190.

Figure 13:
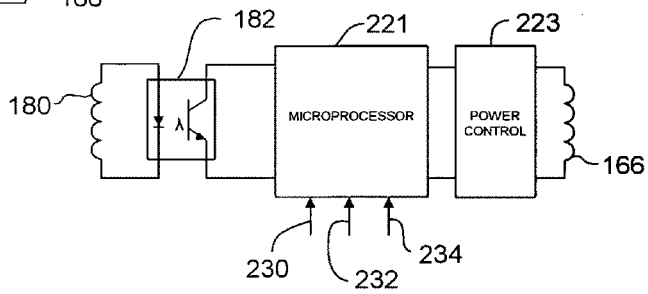
FIG. 13 shows feedback control of the control transformer by a microprocessor optically coupled to the current transformer and showing inputs.

FIG. 13 shows a circuit wherein the signal from the feedback coil 180 of the current transformer 190 is conditioned by a microprocessor or micro controller 221 to deliver a signal to the control coil 166. The microprocessor or micro controller 221 may be optically coupled to the feedback coil 180 of the current transformer 190 in order to isolate it from noise spikes in the voltage or voltage levels inconsistent with those required as inputs to the microprocessor or micro controller 221. The microprocessor or micro controller 221 may further receive inputs from a temperature controller, ambient light controller, manual control, scheduled controller, sensory and control elements such as a resistive control, a light sensor, a temperature sensor or other devices required by the application to control or maintain the light level. The input may be singular or a plurality as shown in FIG. 13 as inputs 230, 232, and 234. The microprocessor or micro controller 221 is further connected to power control circuitry as depicted in FIG. 9 through FIG. 11 to interface the microprocessor or micro controller 221 to the control coil 166.

Figure 14:
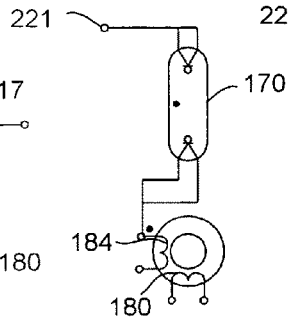
FIG. 14 shows an arc lamp in an instant start configuration. The lamp has a pair of windings of the current transformer in series with the lamp with a third winding providing a feedback voltage to the feedback and control circuit.

FIG. 14 shows a configuration of "Current Transformer 190" and the "Lamp and Start Circuit 192" wherein the Lamp 170 is in an Instant Start arrangement. Instant Start requires the provision of approximately 600 volts across the lamp. This configuration generally provides a striking time of approximately 500 milliseconds.

Figure 15:
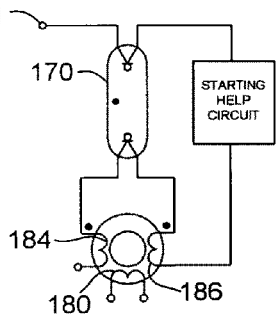
FIG. 15 shows an arc lamp in a rapid start configuration. The lamp has a single winding of the current transformer in series with the lamp with a second winding providing a feedback voltage to the feedback and control circuit.

FIG. 15 shows a configuration of "Current Transformer 190" and where the load is the "Lamp and Start Circuit 192" wherein the Lamp 170 is in a Rapid Start arrangement. The start circuit in rapid start is generally a capacitor, the value of which is chosen to provide a high enough voltage across the lamp to ignite the arc inside the lamp. This configuration generally provides striking of the lamp arc after the filaments are hot Current feedback from a secondary of the control transformer controls or maintains the load level by monitoring current delivered to the primary of the current transformer in series with the load. The level is maintained by feeding back the current from the secondary modulated by circuits depicted in FIGS. 9, 10, 11 and 12. Modification of the load level is accomplished by processing inputs to the microprocessor from sensors and controllers as depicted in FIG. 13 and modifying the feedback current according to programmed parameters.

As will be obvious to persons skilled in the art, various modifications, adaptations, and variations of the specific disclosure can be made without departing from the teaching of the invention.

The invention claimed is:

1. An auto-dimming apparatus consisting of:

a circuit having a control apparatus, a control transformer, a power inverter circuit, a current transformer, and a feedback circuit for supplying a feedback controlled current to a load wherein;

said control apparatus consists of:

a control coil wound on a bobbin and a control inductor wound on a core of magnetic material wherein said control inductor wound on a core of magnetic material is disposed within a magnetic path of said bobbin;

said control transformer consists of:

a core of magnetic material upon which is wound at least one primary coil for receiving an input electrical signal need precedence;

said core of magnetic material additionally having at least one secondary coil for supplying an output electrical signal precedence proportional to a turns ratio defined by the number of turns of the secondary coil in the numerator to the number of turns of the primary coil in the denominator and a primary current;

said core of magnetic material being fabricated from a magnetically soft material;

said control apparatus connected in parallel to said primary coil of said control transformer;

said control inductor of said control apparatus receiving a control electrical signal from said feedback circuit wherein said control current generates a magnetic field;

said magnetic field causing a change in magnetic properties of the core of magnetic material of said control apparatus in a physically non-coupled manner wherein said magnetic properties in said core of magnetic material is varied as said control electrical signal in said control coil is varied;

said output voltage of said control transformer decreases with the decrease of said magnetic properties;

said current transformer having at least one primary winding and a plurality of secondary windings:

said primary winding of the current transformer receiving a current from the secondary coil of the control transformer; wherein a first secondary windings serving to provide a feedback current to the control inductor of said control apparatus;

said additional secondary windings being optionally provided for input by at least one of the group consisting of an external controller, a microprocessor, and a monitoring system; and said feedback circuit useful for conditioning said feedback current from said current transformer and being chosen from the group consisting of a DC coupled feedback and control circuit, an AC coupled feedback and control circuit, and an optically coupled microprocessor feedback and control circuit.

2. The auto-dimming apparatus of claim 1, wherein the core of magnetic material is chosen from the group consisting of a core of magnetic material and a core of magnetic material having a closed magnetic path.

3. The auto-dimming apparatus of claim 1, wherein the load is chosen from the group consisting of fluorescent lamps, cold cathode fluorescent lamps, and electro-luminescent panels, halogen lamps,HID lamps, metal halide lamps, and switching power supplies.

4. The auto-dimming apparatus of claim 1, wherein the control transformer has one primary coil for receiving an input voltage and said at least one secondary coil is a first secondary coil and a second secondary coil each supplying said output voltage and current;

said first secondary coil and said second secondary coil being wound on said core of magnetic material common to said primary coil to produce voltages out of phase from one another;

said first secondary coil and said second secondary coil each communcatingly control said power inverter circuit for producing an AC power source;

a first end of said first secondary coil is communicatingly attached to a control pin of a first inverter transistor and second end of said first secondary coil is attached to a ground voltage and a collector of a second inverter transistor;

a first end of said second secondary coil is communicatingly attached to a control pin of said second inverter transistor and a second end of said second secondary coil is attached to an output power pin of said second inverter transistor;

a positive DC voltage being supplied to an input power pin of said first inverter transistor and a ground voltage being supplied to a junction of an output power pin of said first inverter transistor and a input power pin of said second inverter transistor;

said input power pin of said first inverter transistor is communicatingly attached to a first terminal of a series resonant inductor having a second terminal attached to a first terminal of a load;

a second terminal of said load is attached to a first terminal of a series resonant capacitor while a second terminal is attached to a first terminal of the primary of said control transformer;

a second terminal of the primary of said control transformer is attached to said ground voltage;

said power inverter circuit for producing an AC power source is controlled through the application of said control current from one of the group of a DC source and a low frequency AC source to a pair of input terminals of said control coil;

said control current creating a magnetic field for controlling the magnetic properties of said core of magnetic material wherein an output power of said power inverter circuit is controlled;

said AC power source providing said output power inversely proportional to said control current of said control transformer; and said AC power source in series with the primary of said current transformer being suitable for supplying a controllable power level to an AC receptive load.

5. The power inverter circuit of claim 4 wherein said control current supplied to the control coil of said control transformer is fed back from a secondary winding of said current transformer interposed by said feedback circuit.

6. The control transformer of claim 4 having a winding serving as a current source for an power inverter circuit and also having a primary winding and at least two secondary windings for supplying a pair of inverter transistor control pin inputs chosen from the group consisting of a voltage and current;

a series resonant power inverter circuit for producing an A.C. power source is controlled through the application of said control current from one of the group of a DC source and a low frequency AC source to a pair of input terminals of said control coil;

said control current creating said magnetic field for controlling the magnetic properties of said core of magnetic material wherein an output power of said series resonant power inverter circuit is controlled; and said AC power source providing said output power inversely proportional to said control current of said control transformer.

7. The power inverter circuit of claim 6, wherein said control current supplied to the control coil of said control transformer is controllably modulated by said feedback circuit.

8. The auto-dimming apparatus of claim 1, wherein said optically coupled microprocessor feedback and control circuit has a sensor and control element input wherein at least one of said sensor and control element input is used;

said sensor and control element input chosen from a group consisting of a temperature controller, an ambient light controller, a manual controller, scheduled controller, and sensory and control elements; and said sensory and control elements chosen from a group consisting of a resistive control, a light sensor, a temperature sensor and other devices required by the application to control or maintain a driving signal chosen from the group consisting of a current and a voltage.

9. The auto-dimming apparatus of claim 1, wherein the microprocessor feedback and control circuit is used alone or in combination with a feedback circuit chosen from the group consisting of a DC coupled feedback and control circuit, an AC coupled feedback and control circuit.

10. An auto-dimming apparatus consisting of:

a circuit having a plurality control apparatus, a control transformer, a power inverter circuit, a current transformer, and a feedback circuit for supplying a feedback controlled current to a load wherein;

said control apparatus consists of:

a control coil wound on a bobbin and a control inductor wound on a core of magnetic material wherein said control inductor wound on a core of magnetic material is disposed within a magnetic path of said bobbin and located within said bore by a pair of ferromagnetic poles;

said control transformer consists of:

a core of magnetic material upon which is wound at least one primary coil for receiving an input voltage;

said core of magnetic material additionally having at least one secondary coil for supplying an output voltage proportional to a turns ratio defined by the number of turns of the secondary coil in the numerator to the number of turns of the primary coil in the denominator and a primary current;

said core of magnetic material being fabricated from a magnetically soft material;

said plurality of control apparatus connected in parallel to said primary coil of said control transformer for receiving control inputs from a plurality of sources;

said control inductor of said control apparatus receiving a control current from said feedback circuit wherein said control current generates a magnetic field;

said magnetic field causing a change in magnetic properties of the core of magnetic material of said control apparatus in a physically non-coupled manner wherein said magnetic properties in said core of magnetic material is increased as said control current in said control inductor increases;

said output voltage of said control transformer decreases with the decrease of said magnetic properties;

said current transformer having at least one primary winding and a plurality of secondary windings:

said primary winding of the current transformer receiving a current from the secondary coil of the control transformer; wherein a first secondary windings serving to provide a feedback current to the control inductor of said control apparatus;

said additional secondary windings being optionally provided for input to one of the group consisting of an external controller, a microprocessor, and a monitoring system; and said feedback circuit useful for conditioning said feedback current from said current transformer and being chosen from the group consisting of a DC coupled feedback and control circuit, an AC coupled feedback and control circuit, and an optically coupled microprocessor feedback and control circuit.

11. The auto-dimming apparatus of claim 10, wherein the core of magnetic material is chosen from the group consisting of a toroidal core and a core of magnetic material having a complete magnetic path.

12. The auto-dimming apparatus of claim 10, wherein the load is chosen from the group consisting of fluorescent lamps, cold cathode fluorescent lamps, and electro-luminescent panels, halogen lamps, HID lamps, metal halide lamps, and switching power supplies.

13. The auto-dimming apparatus of claim 10, wherein the control transformer has one primary coil for receiving an input voltage and said at least one secondary coil is a first secondary coil and a second secondary coil each supplying said output voltage and current;

said first secondary coil and said second secondary coil being wound on said core of magnetic material common to said primary coil to produce voltages out of phase from one another;

said first secondary coil and said second secondary coil each communcatingly control said power inverter circuit for producing an AC power source;

a first end of said first secondary coil is communicatingly attached to a control pin of a first inverter transistor and second end of said first secondary coil is attached to a ground voltage and a collector of a second inverter transistor;

a first end of said second secondary coil is communicatingly attached to a control pin of said second inverter transistor and a second end of said second secondary coil is attached to an output power pin of said second inverter transistor;

a positive DC voltage being supplied to an input power pin of said first inverter transistor and a ground voltage being supplied to a junction of an output power pin of said first inverter transistor and a input power pin of said second inverter transistor;

said input power pin of said first inverter transistor is communicatingly attached to a first terminal of a series resonant inductor having a second terminal attached to a first terminal of a load;

a second terminal of said load is attached to a first terminal of a series resonant capacitor while a second terminal is attached to a first terminal of the primary of said control transformer;

a second terminal of the primary of said control transformer is attached to said ground voltage;

said power inverter circuit for producing an AC power source is controlled through the application of said control current from one of the group of a DC source and a low frequency AC source to a pair of input terminals of said control coil;

said control current creating a magnetic field for controlling the magnetic properties of said core of magnetic material wherein an output power of said power inverter circuit is controlled;

said AC power source providing said output power inversely proportional to said control current of said control transformer; and said AC power source in series with the primary of said current transformer being suitable for supplying a controllable power level to an AC receptive load.

14. The power inverter circuit of claim 13 wherein said control current supplied to the control coil of said control transformer is fed back from a secondary winding of said current transformer interposed by said feedback circuit.

15. The control transformer of claim 13 having a winding serving as a Current source for an power inverter circuit and also having a primary winding and at least two secondary windings for supplying a pair of inverter transistor control pin inputs chosen from the group consisting of a voltage and current;

a series resonant power inverter circuit for producing an A.C. power source is controlled through the application of said control current from one of the group of a D.C. source and a low frequency A.C. source to a pair of input terminals of said control coil;

said control current creating said magnetic field for controlling the magnetic properties of said core of magnetic material wherein an output power of said series resonant power inverter circuit is controlled; and said A.C. power source providing said output power inversely proportional to said control current of said control transformer.

16. The power inverter circuit of claim 15, wherein said control current supplied to the control coil of said control transformer is controllably modulated by said feedback circuit.

17. The auto-dimming apparatus of claim 10, wherein said optically coupled microprocessor feedback and control circuit has a sensor and control element input wherein said sensor and control element input is either singular or in the plurality;

said sensor and control element input chosen from a group consisting of a temperature controller, an ambient light controller, a manual controller, scheduled controller, and sensory and control elements; and said sensory and control elements chosen from a group consisting of a resistive control, a light sensor, a temperature sensor and other devices required by the application to control or maintain the light level.

18. The auto-dimming apparatus of claim 10, wherein the microprocessor feedback and control circuit is used alone or in combination with a feedback circuit chosen from the group consisting of a DC coupled feedback and control circuit, an AC coupled feedback and control circuit.

* * * * *